US008540551B2

(12) United States Patent
Brown et al.

(10) Patent No.: US 8,540,551 B2
(45) Date of Patent: Sep. 24, 2013

(54) GLASS EDGE FINISH SYSTEM, BELT ASSEMBLY, AND METHOD FOR USING SAME

(75) Inventors: James W. Brown, Painted Post, NY (US); Jerome T. Firlik, Horseheads, NY (US); Siva Venkatachalam, Painted Post, NY (US); Liming Wang, Painted Post, NY (US); Naiyue Zhou, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 420 days.

(21) Appl. No.: 12/968,586

(22) Filed: Dec. 15, 2010

(65) Prior Publication Data

US 2012/0156972 A1 Jun. 21, 2012

(51) Int. Cl.
*B24B 1/00* (2006.01)

(52) U.S. Cl.
USPC ..... 451/44; 451/296; 451/168; 451/303; 451/305; 451/449

(58) Field of Classification Search
USPC ..... 451/44, 296, 303, 299, 388, 444, 451/168, 302, 305, 449
See application file for complete search history.

(56) References Cited

U.S. PATENT DOCUMENTS 1,635,399 A * 7/1927 Fischer ..... 451/299
1,851,028 A * 3/1932 Worrall ..... 248/363
2,404,844 A * 7/1946 Jackson ..... 451/42
2,562,229 A * 7/1951 Bell ..... 451/303
2,850,852 A * 9/1958 Hofberger ..... 451/296
3,177,627 A * 4/1965 Guibert et al. ..... 451/53
3,321,871 A * 5/1967 Balamuth et al. ..... 451/28
3,468,071 A * 9/1969 Woodward ..... 451/261
3,524,284 A * 8/1970 Mears ..... 451/303
3,753,269 A * 8/1973 Budman ..... 15/160
3,812,622 A * 5/1974 Parsons ..... 451/72
4,109,422 A * 8/1978 Parsons ..... 451/56
4,426,811 A * 1/1984 Eckardt et al. ..... 451/239
4,438,601 A * 3/1984 Olson ..... 451/444
4,525,955 A * 7/1985 Cothrell et al. ..... 451/296
5,003,729 A * 4/1991 Sherby ..... 451/38
5,163,249 A * 11/1992 Kantanen ..... 451/296
5,274,964 A * 1/1994 Simpson et al. ..... 451/38
5,628,672 A * 5/1997 Heesemann ..... 451/5
6,186,136 B1 * 2/2001 Osborne ..... 125/21
6,325,704 B1 12/2001 Brown et al. ..... 451/44
6,447,374 B1 * 9/2002 Sommer et al. ..... 451/56
6,558,239 B2 * 5/2003 Kunisawa et al. ..... 451/303
6,685,541 B2 2/2004 Brown et al. ..... 451/41

(Continued)

*Primary Examiner* — George Nguyen
(74) *Attorney, Agent, or Firm* — Thomas R. Beall; William J. Tucker, Esq.

(57) ABSTRACT

A glass edge finishing system, a belt assembly and a method are described herein for finishing an edge of a glass sheet. The glass edge finishing system comprises: (a) a base; and (b) one or more belt assemblies located on the base, where each belt assembly includes: (i) a support frame; (ii) a motor; (iii) a pair of pulleys rotatably mounted on the support frame and driven by the motor; (iv) a belt engaged to and driven by the pair of pulleys, where the belt contacts and finishes the edge of the glass sheet; (v) a belt cleaning device that removes glass debris from the belt as the belt moves past the belt cleaning device; and (vi) a cleaning containment enclosure within which there is located the belt cleaning device, where the cleaning containment enclosure contains the glass debris removed from the belt by the belt cleaning device.

22 Claims, 12 Drawing Sheets

(56) References Cited

U.S. PATENT DOCUMENTS

| | | | | |
|---|---|---|---|---|
| 6,910,953 | B2 * | 6/2005 | Allaire et al. | 451/44 |
| 6,974,369 | B2 * | 12/2005 | Mizun | 451/255 |
| 8,210,905 | B2 * | 7/2012 | Sakairi | 451/44 |
| 2001/0011002 | A1 * | 8/2001 | Steere, III | 451/168 |
| 2002/0068514 | A1 * | 6/2002 | Margaria | 451/44 |
| 2005/0020193 | A1 * | 1/2005 | Allaire et al. | 451/44 |
| 2009/0004952 | A1 * | 1/2009 | Takahashi et al. | 451/44 |
| 2010/0112909 | A1 * | 5/2010 | Yamaguchi et al. | 451/44 |

* cited by examiner

GLASS EDGE FINISH SYSTEM, BELT ASSEMBLY, AND METHOD FOR USING SAME

TECHNICAL FIELD

The present invention relates in general to the glass manufacturing field and, in particular, to a glass edge finishing system, a belt assembly and a method for finishing an edge of a glass sheet.

BACKGROUND

Sheet glass manufacturing requires three steps, melting of raw material, forming the melted glass into the proper shape which in this case is thin glass sheets (e.g., 3 mm thick or less), and finally shaping the thin glass sheets into a final shape which is satisfactory for the user of the glass sheets. The final shaping step includes separating near net shaped thin glass sheets from the glass ribbon, sizing the thin glass sheets through a cutting operation and edging the thin glass sheets to strengthen the thin glass sheets for handling operations. The discussion herein relates to the edging of the thin glass sheets.

Thin glass sheet edging is typically done today by utilizing a grinding wheel which has groove(s) formed therein. The formed groove(s) create a shape on the edge of the thin glass sheet that mirrors the groove. Unfortunately, there are several problems with using a grinding wheel to edge the thin glass sheets. A list of several of these problems follows:

1. Producing a consistent formed groove in the grinding wheel is becoming increasingly difficult due to the thinner glass sheets.

2. The grinding wheel's formed groove becomes misshapen with use causing an inconsistent edge shape in the glass sheet.

3. The surface area being used by the grinding wheel is limited to the formed groove which increases the cost due to the poor utilization of material.

4. The relatively small area of the grinding wheel which can come into contact with the edge of the glass sheet necessitates the use of coarser grain sizes which ultimately results in a poorer surface finish on the edge of the glass sheet.

5. The edge polishing process is unable to remove major flaws in the edge of the glass sheet which are generated during the cutting process and limits the strength of the edge of the glass sheet.

6. The lack of chip clearance between the glass sheet and the grinding wheel during the grinding process increases the potential for causing defects in the glass sheet due to the grinding wheel becoming clogged by chips (e.g., glass particles) from the glass sheet.

7. Particulates (e.g., chips, glass particles) can be imbedded within the grinding wheel's grooves which can limit the effectiveness of the grinding wheel.

8. Improvements to edge finish smoothness requires a multi-step process of grinding wheels each with a separate motor-spindle requirement that increases cost, process losses and are difficult to setup.

9. The edge of the glass sheet after grinding (polishing) is not smooth enough to prevent particle trapping, which could contribute significantly to an undesirable surface particle count due to late particle release.

10. The grinding wheel process requires a large amount of stock (80 um to 200 um) to remove the scoring defects in the glass sheet. This generates a large amount of particles which contaminate and adhere to the surfaces of the glass sheet and require an expensive washing process to clean the surfaces of the glass sheet.

As stated above the current process of edging a thin glass sheet using the grinding wheel has several drawbacks, specifically when it comes to edge strength or in another term the durability of the edged thin glass sheet as it relates to handling. Accordingly, there is a need for a new edging process that overcomes the aforementioned problems and other problems associated with edging thin glass sheets. This need and other needs are satisfied by the present invention.

SUMMARY

A glass edge finishing system, a belt assembly and a method for finishing an edge of a glass sheet have been described in the independent claims of the present application. Advantageous embodiments of the glass edge finishing system, the belt assembly and the method for finishing an edge of a glass sheet have been described in the dependent claims.

In one aspect, the present invention provides a glass edge finishing system for finishing an edge of a glass sheet. The glass edge finishing system comprises: (a) a base; and (b) one or more belt assemblies located on the base, where each belt assembly includes: (i) a support frame; (ii) a motor; (iii) a pair of pulleys rotatably mounted on the support frame and driven by the motor; (iv) a belt engaged to and driven by the pair of pulleys, where the belt contacts and finishes the edge of the glass sheet; (v) a belt cleaning device that removes glass debris from the belt as the belt moves past the belt cleaning device; and (vi) a cleaning containment enclosure within which there is located the belt cleaning device, where the cleaning containment enclosure contains the glass debris removed from the belt by the belt cleaning device.

In another aspect, the present invention provides a belt assembly for finishing an edge of a glass sheet. The belt assembly comprises: (i) a support frame; (ii) a motor; (iii) a pair of pulleys rotatably mounted on the support frame and driven by the motor; (iv) a belt engaged to and driven by the pair of pulleys, where the belt contacts and finishes the edge of the glass sheet; (v) a belt cleaning device that removes glass debris from the belt as the belt moves past the belt cleaning device; and (vi) a cleaning containment enclosure within which there is located the belt cleaning device, where the cleaning containment enclosure contains the glass debris removed from the belt by the belt cleaning device.

In yet another aspect, the present invention provides a method for finishing an edge of a glass sheet. The method comprises the steps of: (a) moving the glass sheet past one or more belt assemblies, where each belt assembly includes: (i) a support frame; (ii) a motor; (iii) a pair of pulleys rotatably mounted on the support frame and driven by the motor; (iv) a belt engaged to and driven by the pair of pulleys; (v) a belt cleaning device; and (vi) a cleaning containment enclosure within which there is located the belt cleaning device; and (b) operating the one or more belt assemblies, wherein each belt assembly rotates the belt such that the belt contacts and finishes the edge of the glass sheet, the belt cleaning device removes glass debris from the belt as the belt rotates past the belt cleaning device, and the cleaning containment enclosure contains the glass debris removed from the belt by the belt cleaning device.

Additional aspects of the invention will be set forth, in part, in the detailed description, figures and any claims which follow, and in part will be derived from the detailed description, or can be learned by practice of the invention. It is to be understood that both the foregoing general description and the following detailed description are exemplary and explanatory only and are not restrictive of the invention as disclosed.

BRIEF DESCRIPTION OF THE DRAWINGS

A more complete understanding of the present invention may be had by reference to the following detailed description when taken in conjunction with the accompanying drawings wherein.

DETAILED DESCRIPTION

Figure 1A:
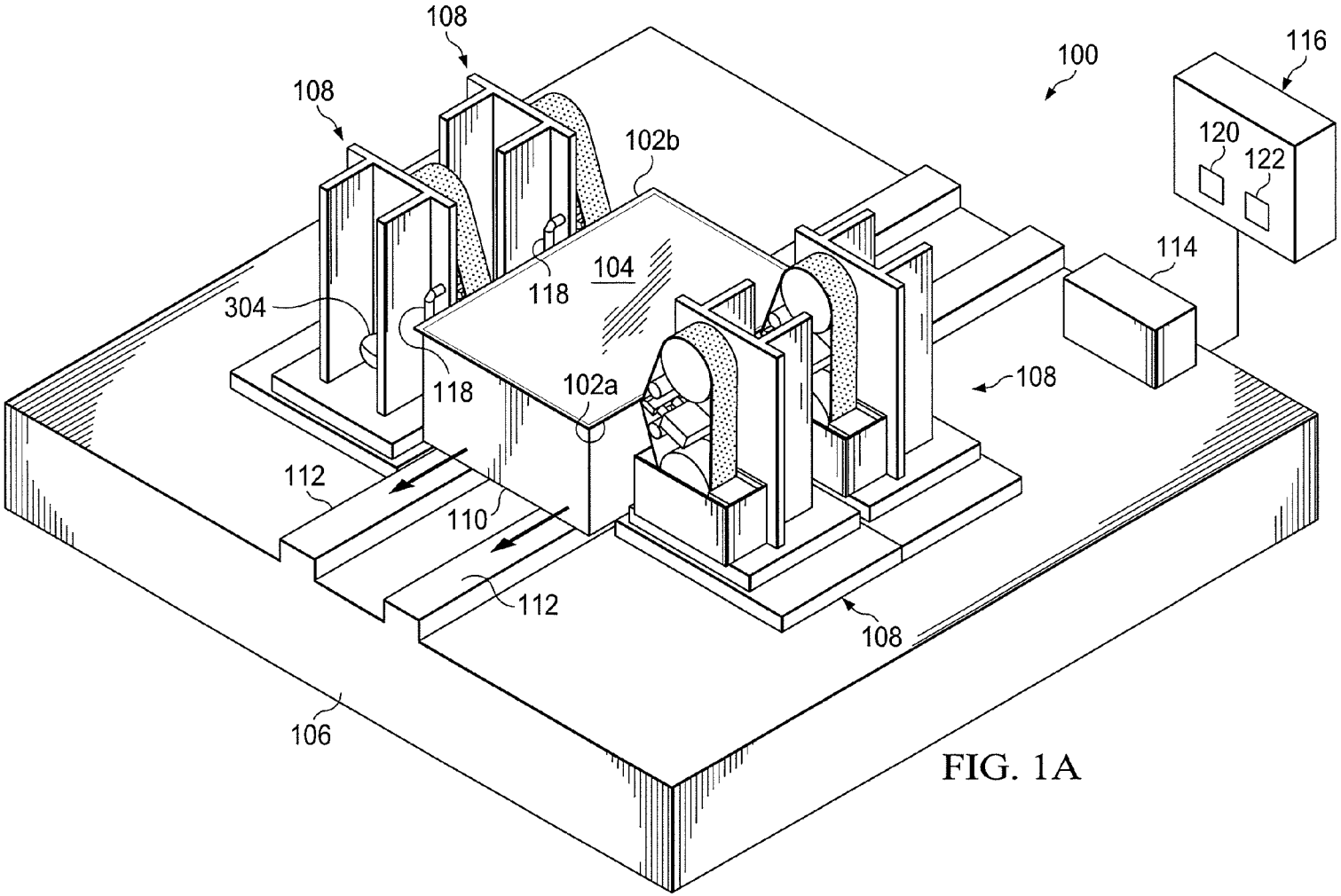
FIG. 1A is diagram illustrating a perspective view of an exemplary glass edge finishing system configured to finish two edges of a glass sheet in accordance with an embodiment of the present invention.
Figure 1B:
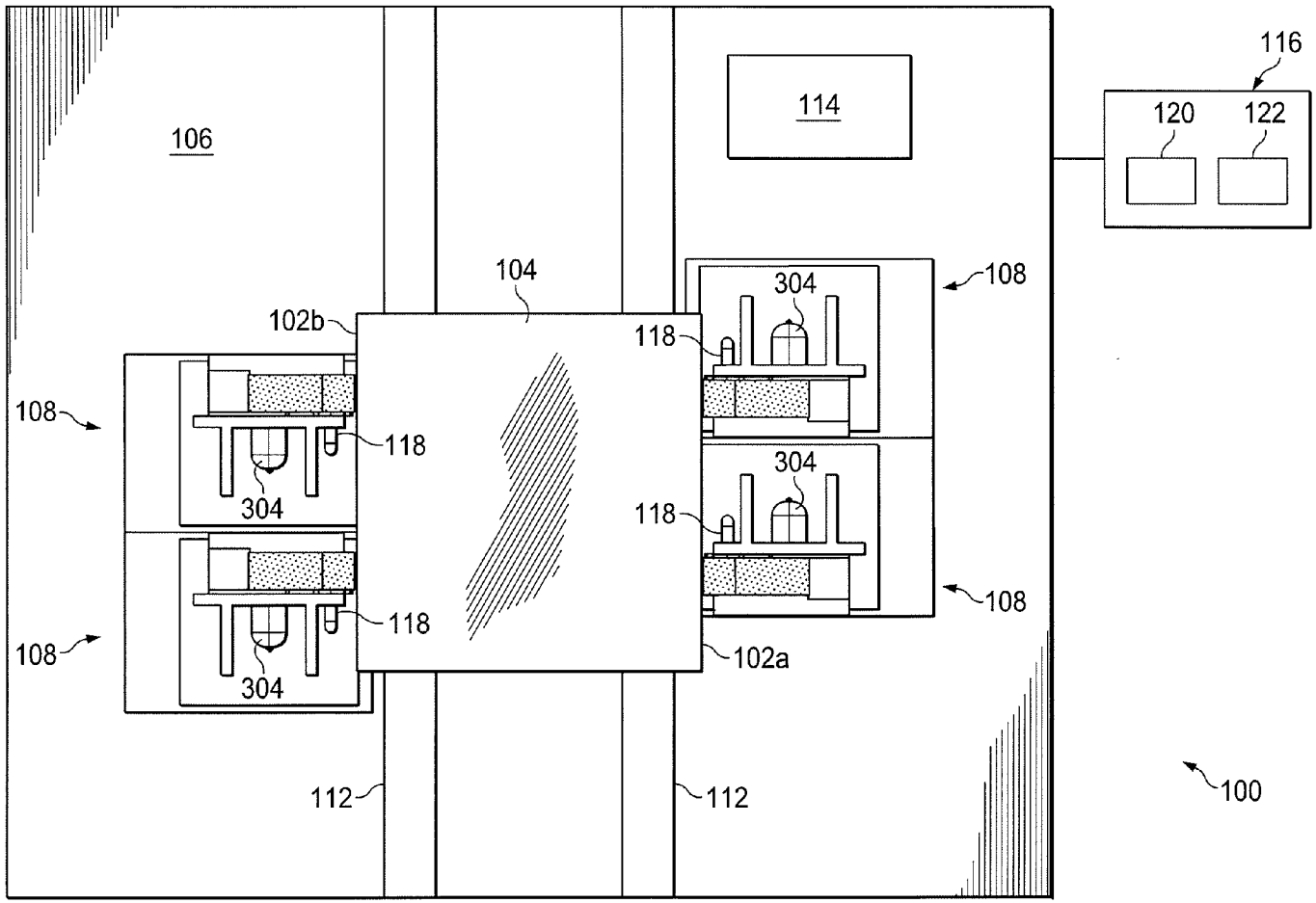
FIG. 1B is a diagram illustrating a top view of the exemplary glass edge finishing system configured to finish two edges of the glass sheet in accordance with an embodiment of the present invention.
Figure 1C:
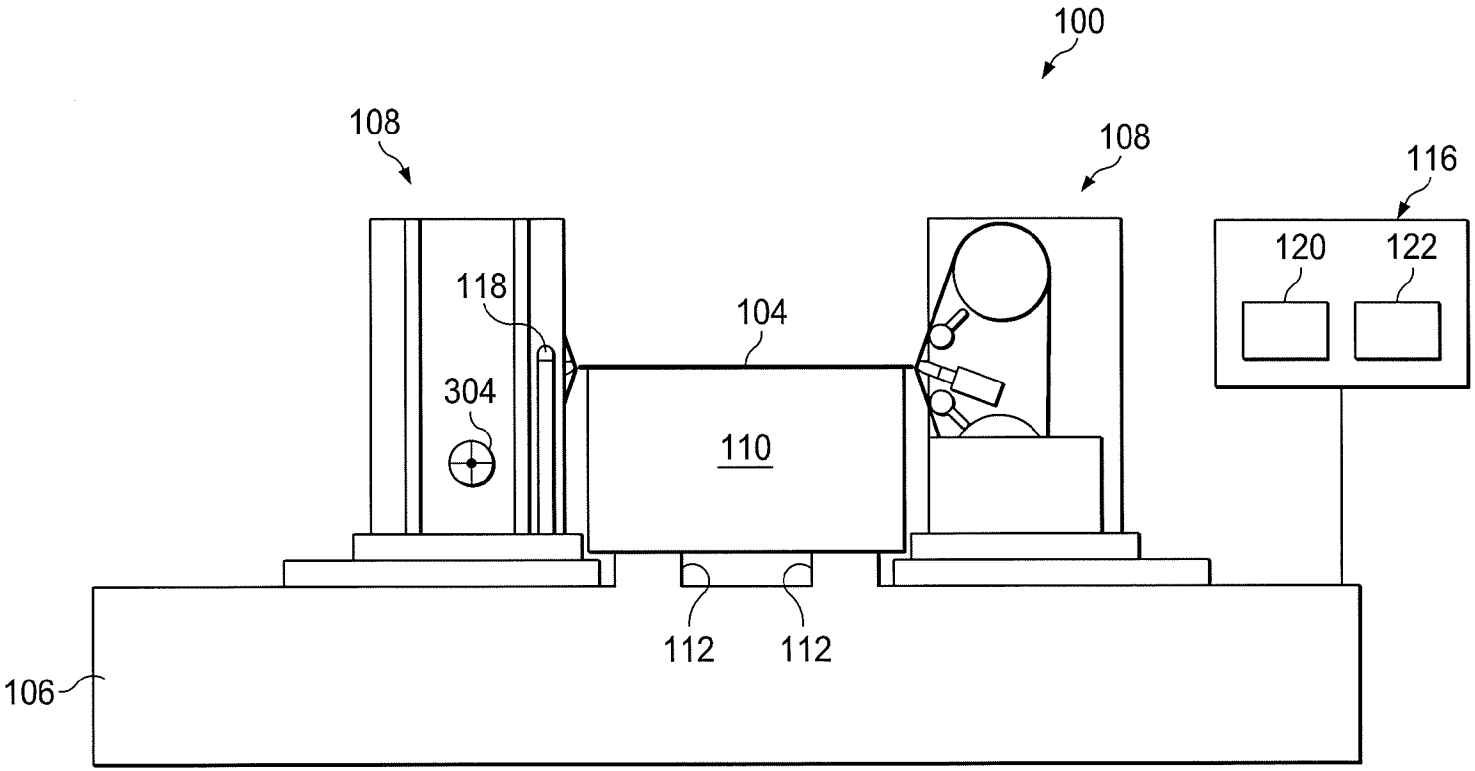
FIG. 1C is a diagram illustrating a front view of the exemplary glass edge finishing system configured to finish two edges of the glass sheet in accordance with an embodiment of the present invention.

Referring to FIGS. 1A-1C, there are several diagrams illustrating different views of an exemplary glass edge finishing system 100 configured to finish two edges 102*a* and 102*b* of a glass sheet 104 in accordance with an embodiment of the present invention. The exemplary glass edge finishing system 100 includes a base 106, one or more belt assemblies 108 (four shown), a vacuum table 110, a motion system 112, a coolant delivery system 114, and a controller 116. As shown, the base 106 supports the belt assemblies 108, the vacuum table 110, the motion system 112 and the coolant delivery system 114. The vacuum table 110 has holes therein through which air is drawn to support and secure the glass sheet 104. The motion system 112 is attached to and moves the vacuum table 110 and the secured glass sheet 104 in a linear motion past the belt assemblies 108 so the secured glass sheet 104 has one edge 102*a* finished by two belt assemblies 108 and another edge 102*b* finished by the other two belt assemblies 108. The coolant delivery system 114 which has multiple delivery components 118 (four shown) through which a coolant (e.g., gas, liquid) is delivered to each cutting zone (belt and glass interface) to cool the glass sheet 104 and abrasive belt 308 as well as remove the grinding particles and debris from of the glass sheet 104. The controller 116 includes a processor 120 and a non-transitory computer-readable storage medium 122 which has an executable program stored thereon, where the executable program instructs the processor 120 to control the operations of the belt assemblies 108, the vacuum table 110, the motion system 112, and the coolant delivery system 114 to finish the two edges 102*a* and 102*b* of the glass sheet 104. The glass edge finishing system 100 may include many other components which are well known in the art but for clarity only the components 106, 108, 110, 112, 114, 116, and 118 needed to describe and enable the present invention are discussed herein.

Figure 2B:
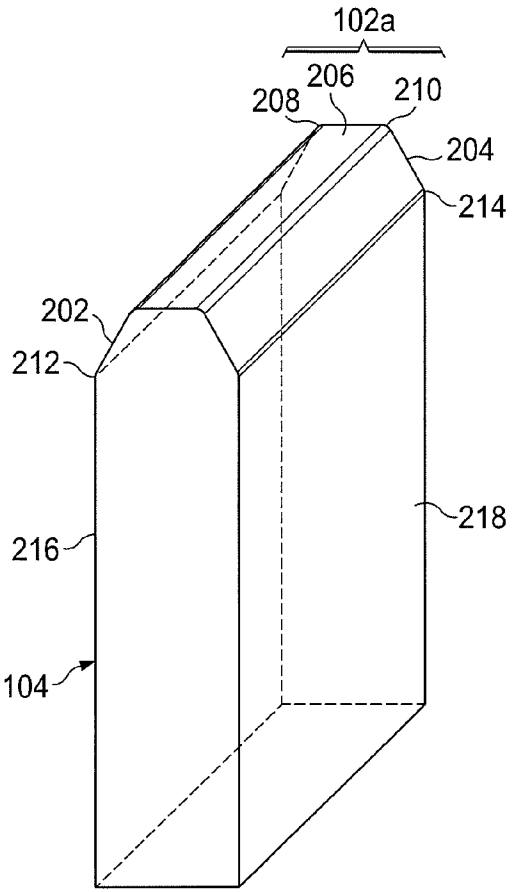
FIGS. 2A-2B are two diagram respectively illustrating a partial side view and a partial perspective view of an exemplary glass sheet that was edged by the glass edge finishing system shown in FIGS. 1A-1C in accordance with an embodiment of the present invention.
Figure 2A:
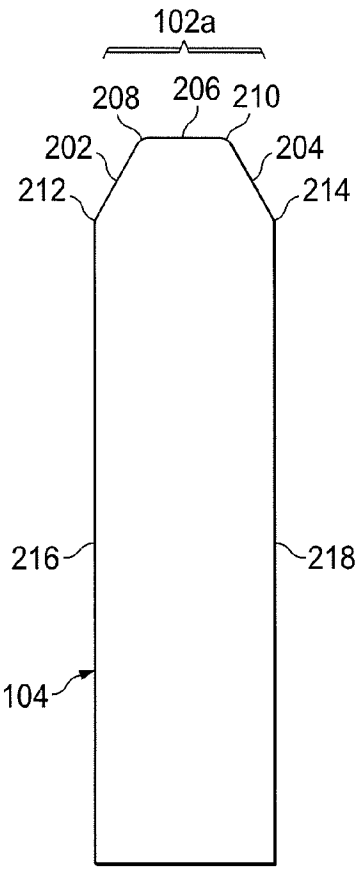

Referring to FIGS. 2A-2B, there are two diagrams respectively illustrating a partial side view and a partial perspective view of one edge 102*a* (for example) of the glass sheet 104 that has been shaped by the glass edge finishing system 100 in accordance with an embodiment of the present invention. In this example, one of the belt assemblies 108 would shape one side 202 of the edge 102*a* and another one of the belt assemblies 108 would shape another side 204 of the edge 102*a*. Thus, the edge 102*a* would have two shaped sides 202 and 204 with a relatively flat portion 206 there between. In addition, the edge 102*a* would have two rounded portions 208 and 210 between the relatively flat portion 206 and the two sides 202 and 204. Furthermore, the edge 102*a* would have two rounded portions 212 and 214 between the sides 202 and 204 and the major surfaces 216 and 218 of the glass sheet 104. The rounded portions 208, 210, 212, and 214 would be created due to a roll-off effect of the belts 308. Alternatively, the belt assemblies 108 can finish the edges 102*a* and 102*b* of the glass sheet 104 so they have any desired shape and one would not be limited to the particular shape of the illustrated glass sheet 104. A detailed discussion about the various components that make-up the belt assemblies 108 that shape the edges 102*a* and 102*b* of the glass sheet 104 is provided next with respect to FIGS. 3A-3D.

Figure 3A:
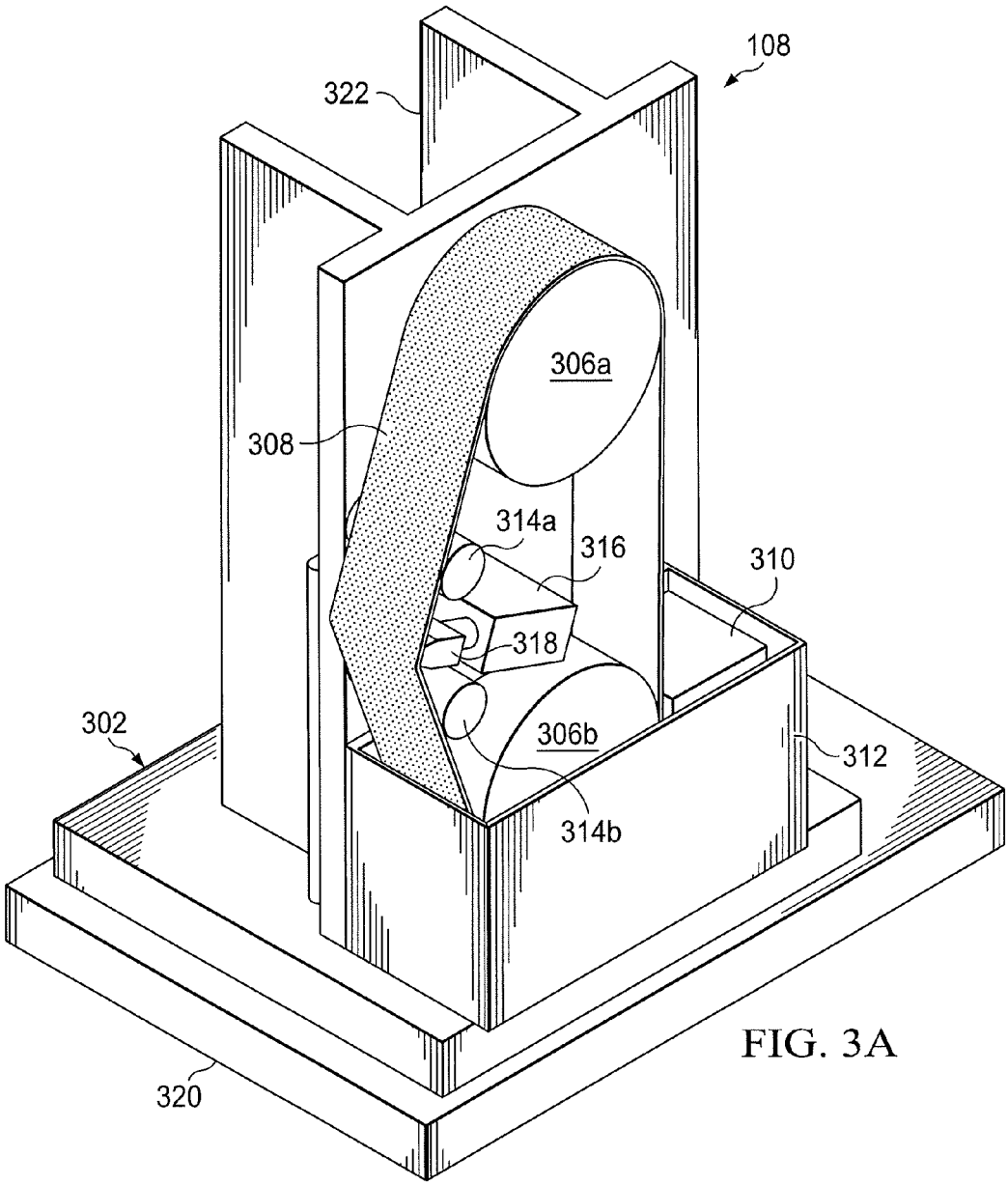
FIG. 3A is a diagram illustrating a perspective view of an exemplary belt assembly which is used in the glass edge finishing system shown in FIGS. 1A-1C in accordance with an embodiment of the present invention.
Figure 3B:
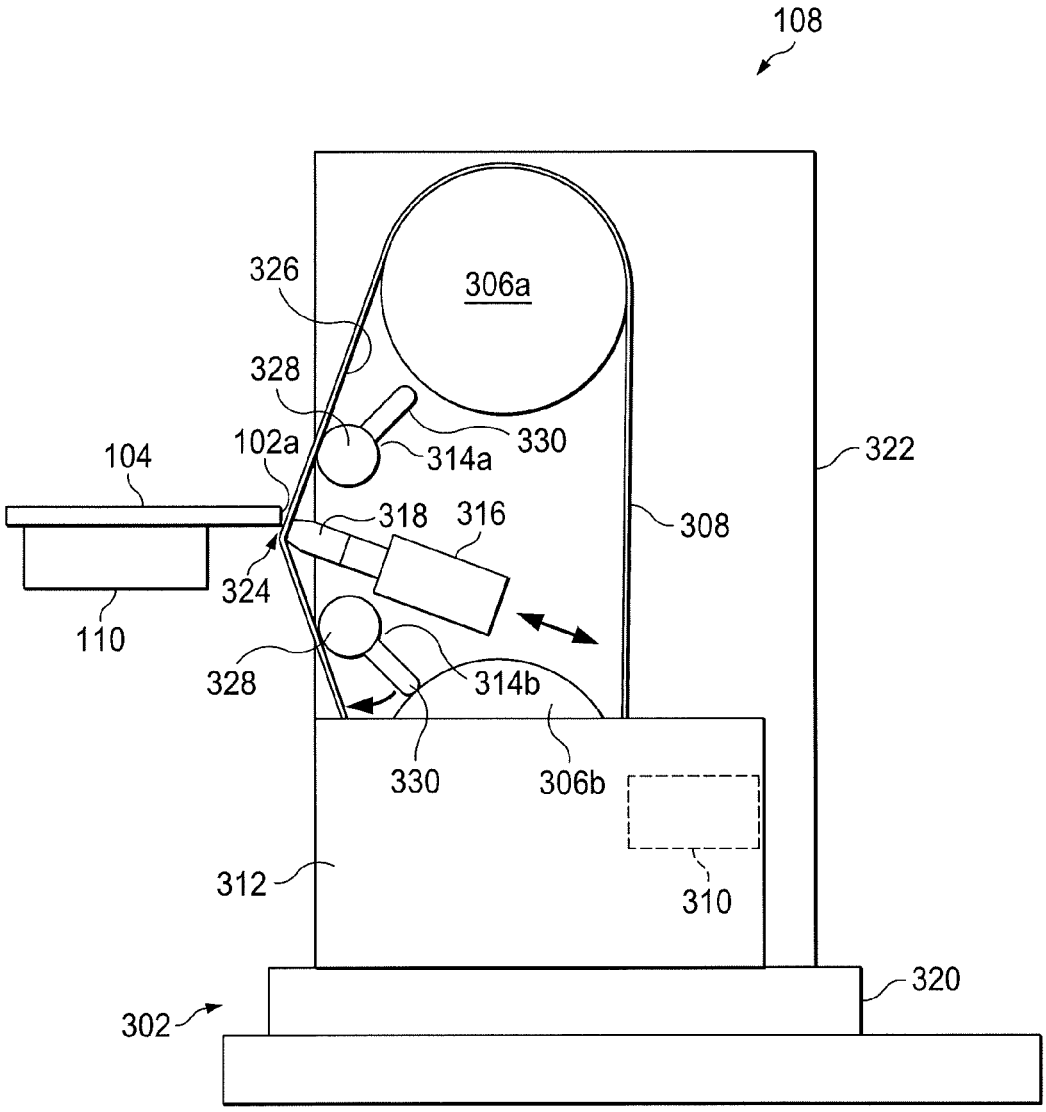
FIG. 3B is a diagram illustrating a side view of the exemplary belt assembly which is used in the glass edge finishing system shown in FIGS. 1A-1C in accordance with an embodiment of the present invention.

Referring to FIGS. 3A-3D, there are several diagrams illustrating different embodiments of the exemplary belt assembly 108 that can be used in the exemplary glass edge finishing system 100 in accordance with the present invention. As shown in FIGS. 3A-3B, the exemplary belt assembly 108 includes a support frame 302, a motor 304 (see FIGS. 1A-1C), a pair of pulleys 306*a* and 306*b*, a belt 308, a belt cleaning device 310, a cleaning containment enclosure 312, one or more tension rollers 314*a* and 314*b* (two shown), a pusher 316, and a formed backer 318. The support frame 302 includes a base 320 with a bracket 322 extending upward which on one side there is supported the motor 304 and on the other side there is supported the pair of pulleys 306*a* and 306*b*, the abrasive belt 308, the belt cleaning device 310, the cleaning containment enclosure 312, the tension roller(s) 314*a* and 314*b*, the pusher 316, and the formed backer 318. The belt assembly 108 may include many other components which are well known in the art but for clarity only the components 302, 304, 306*a*, 306*b*, 308, 310, 312, 314*a*, 314*b*, 316 and 318 needed to describe and enable the present invention are discussed herein.

In this example, the pulleys 306*a* and 306*b* which are separated from one another by a desired distance are rotatably mounted on one side of the bracket 322 and driven at a desired speed and torque by the motor 304. The motor 304 and an optional gear box (not shown) is mounted on the other side of the bracket 322 and directly attached to one of the pulleys 306*a* and 306*b*. The abrasive belt 308 is wrapped around the pulleys 306*a* and 306*b* so as to be engaged to and rotatably driven by the pulleys 306*a* and 306*b*. In particular, the abrasive belt 308 is positioned such that an outer portion 324 thereof contacts and finishes the edge 102*a* of the glass sheet 104 (see FIGS. 1A-1D and 3B). The abrasive belt 308 could have diamond particles thereon to shape the glass sheet 104 but other minerals have demonstrated equal success in removal of glass such as silicon carbide or aluminum oxide. For example, the abrasive belt 308 could have a 800 mesh grit. To properly position the abrasive belt 308, two tension rollers 314*a* and 314*b* and the combined pusher 316 and formed backer 318 are used such that the outer portion 324 of the rotating belt 308 is properly positioned to contact, shape and finish the edge 102*a* of the glass sheet 104.

The two tension rollers 314*a* and 314*b* are positioned between the two pulleys 306*a* and 306*b* so as to contact and press against an inner side 326 of the abrasive belt 308 to apply a predetermined tension to the abrasive belt 308. For instance, each tension rollers 314*a* and 314*b* would have a roller 328 rotatably mounted to a support arm 330 which is secured in a desired position to one side of the bracket 322 such that the roller 328 contacts and presses with a predetermined force against the inner side 326 of the abrasive belt 308. The combined pusher 316 and formed backer 318 are located between the two tension rollers 314*a* and 314*b*. The pusher 316 (e.g., pneumatic pusher 316, motorized pusher 316) is moved so the formed backer 318 is pushed with a desired force against the inner side 326 of the belt 308 so the outer portion 324 thereof is in a proper position to contact, shape, and finish the edge 102*a* of the glass sheet 104. Basically, the formed backer 318 when positioned behind the abrasive belt 308 helps perform the blending or shaping of the edge 102*a* of the glass sheet 104. Plus, the formed backer 318 can perform better when mounted to the pneumatic or motorized pusher 316 which pushes the formed backer 310 into the abrasive belt 308 with a fixed force to enable the required glass removal to shape the edge 102*a* of the glass sheet 104. The formed backer 318 can be made of a smooth low friction material such as Teflon and can have any desired shape such as a flat end, a round end, or a shaped end depending on how one wants to finish the edge 102*a* of the glass sheet 104. In an alternative, a back-up roller (not shown) can be used instead of the formed backer 318. The back-up roller would have an appropriate diameter to avoid any sort of contact between the belt 308 and the pusher 316 which would be detrimental to the belt life and process consistency.

As shown, the belt assembly 108 also includes the belt cleaning device 310 which is located within the cleaning containment enclosure 312. The belt cleaning device 310 functions to remove grinding glass debris from the belt 308 as it moves (or rotates) past the belt cleaning device 310. For example, the belt cleaning device 310 can include one or more brushes (e.g., rotating brushes, stationary brushes), or spray nozzles (e.g., high pressure cleaning jet). The cleaning containment enclosure 312 functions to contain the grinding glass debris that is removed from the belt 308 by the belt cleaning device 310. The cleaning containment enclosure 312 is desirable since it prevents the grinding glass debris that is removed from the belt 308 by the belt cleaning device 310 from being re-introduced back onto the pristine glass sheet 104. Another advantage of using the belt cleaning device 310 and the cleaning containment enclosure 312 is that this type of cleaning allows for a more uniform surface of the belt 308 to come into contact with the glass sheet 104 as material removal is taking place.

Figure 3C:
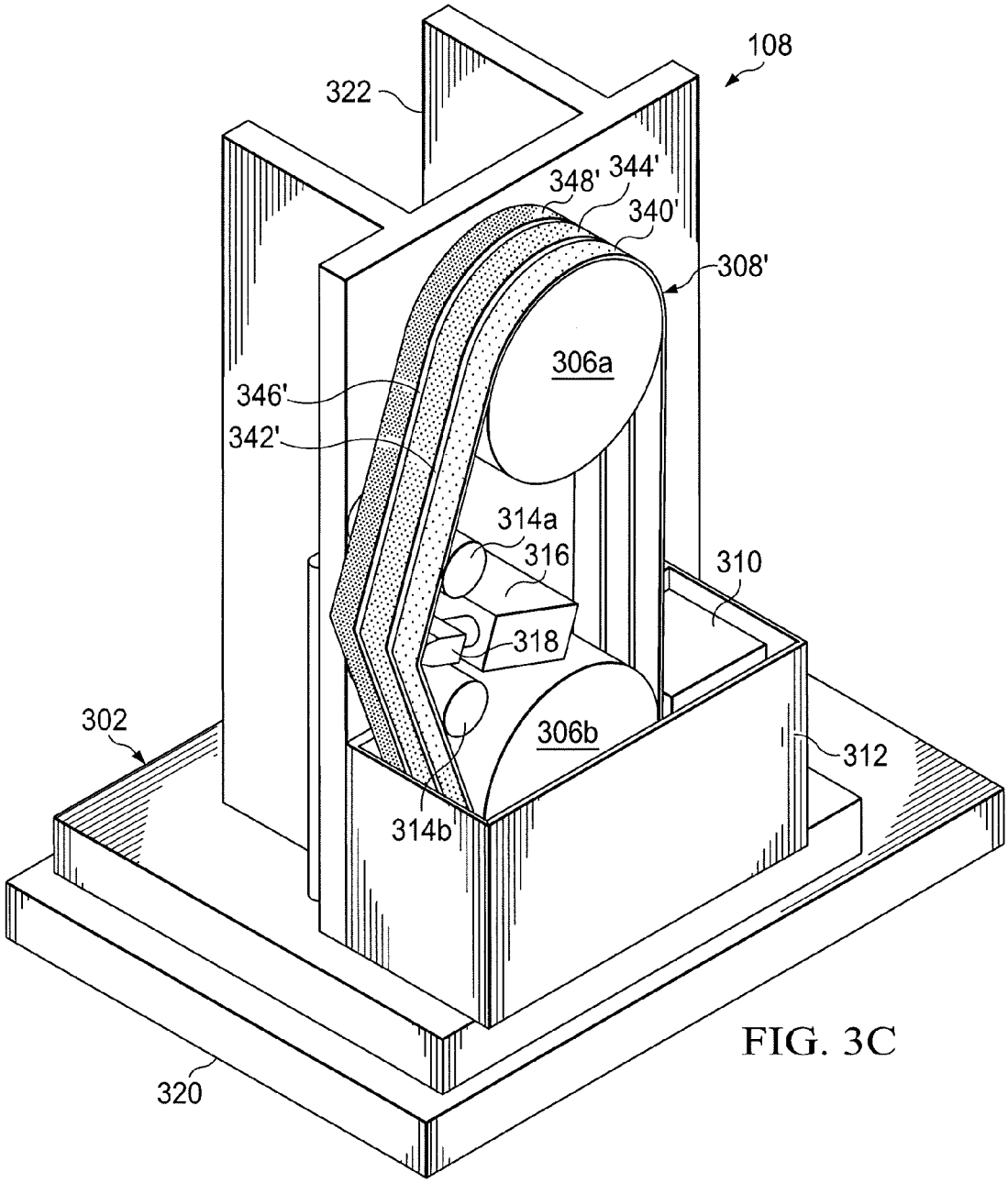
FIG. 3C is a diagram illustrating a perspective view of the exemplary belt assembly which has a composite belt with multiple meshes that could be used in the glass edge finishing system shown in FIGS. 1A-1C in accordance with an embodiment of the present invention.

Referring to FIG. 3C, there is a diagram illustrating a perspective view of the exemplary belt assembly 108 utilizing a composite multiple mesh abrasive belt 308' in accordance with an embodiment of the present invention. In this example, the composite multiple mesh abrasive belt 308' has a coarse matrix mesh 340' (e.g., 320 mesh grit), a recess 342', a medium matrix mesh 344' (e.g., 800 mesh grit), a recess 346', and a fine matrix mesh 348' (e.g., 1200 mesh grit). The composite multiple mesh abrasive belt 308' provides a stepped removal approach to shape the glass sheet 104 where the edge 102*a* of the glass sheet 104 is first shaped by the coarse matrix mesh 340' and then the medium matrix mesh 344' and finally by the fine matrix mesh 348'. The recesses 342' and 346' improve the surface contact between the abrasive belt 308' and the edge 102*a* of the glass sheet 104. In addition, the composite multiple mesh abrasive belt 308' has advantages for belt usage, surface roughness and edge quality. Plus, the belt 308' can minimize edge deflection due to the normal force exerted on the glass sheet 104 by the formed backer 318. This can be important since the thin glass sheet 104 often has a low stiffness. If desired, the composite multiple mesh abrasive belt 308' can have any number of meshes with different grits and recess sizes to enable the stepped removal approach to shape the glass sheet 104.

Figure 3D:
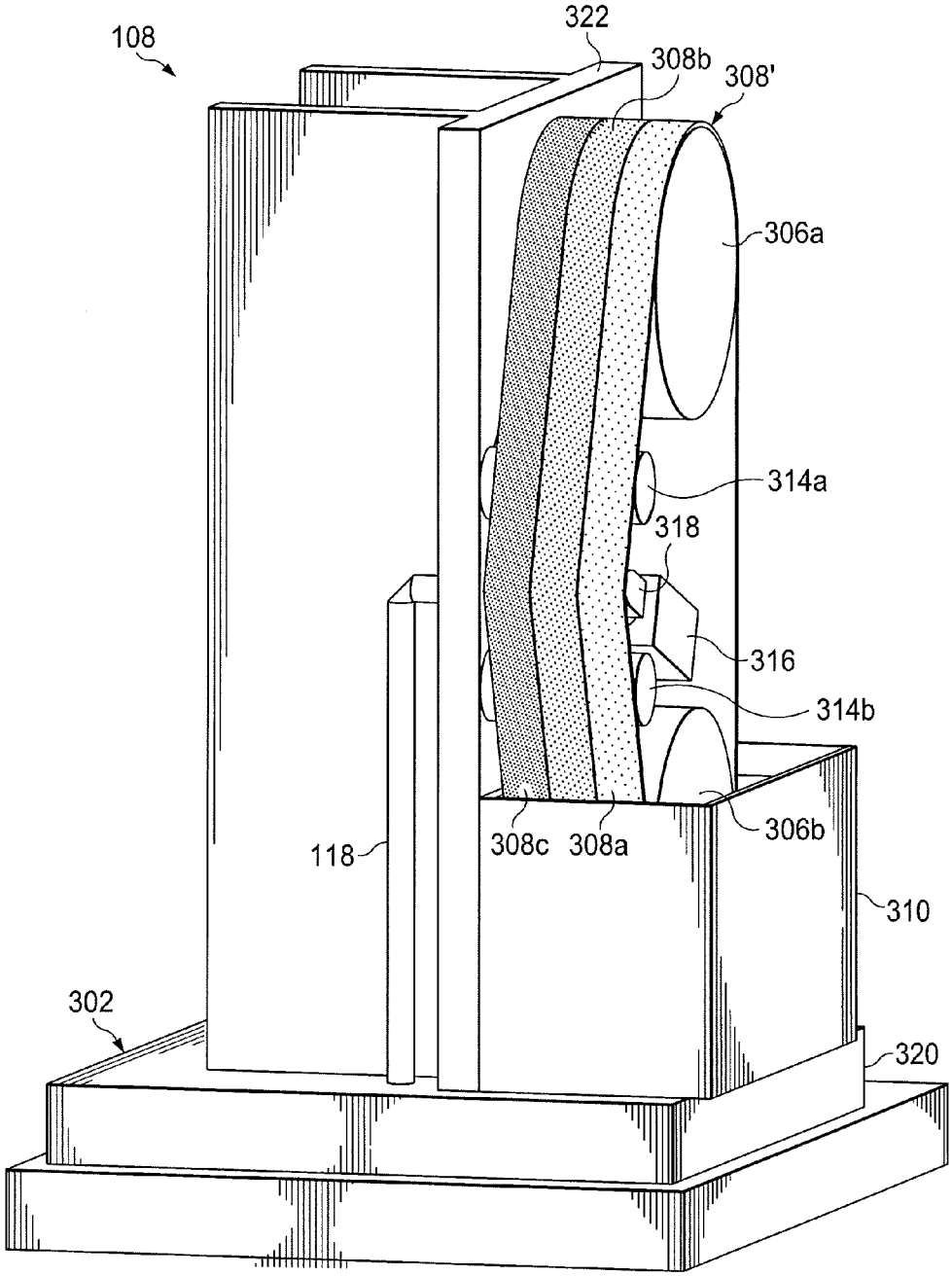
FIG. 3D is a diagram illustrating a perspective view of the exemplary belt assembly which has multiple belts that could be used in the glass edge finishing system shown in FIGS. 1A-1C in accordance with an embodiment of the present invention.

Referring to FIG. 3D, there is a diagram illustrating a perspective view of the exemplary belt assembly 108 utilizing multiple belts 308*a*, 308*b* and 308*c* in accordance with an embodiment of the present invention. In this example, the belt assembly 108 uses the same driving mechanism namely the motor 304 and pulleys 306*a* and 306*b* to rotate the different belts 308*a*, 308*b* and 308*c* which are separated from one another. For instance, the belts 308*a*, 308*b* and 308*c* can respectively have a coarse matrix mesh (e.g., 320 mesh grit), a medium matrix mesh (e.g., 800 mesh grit), and a fine matrix mesh (e.g., 1200 mesh grit). The multiple belts 308*a*, 308*b* and 308*c* provide a stepped removal approach to shape the glass sheet 104 where the edge 102*a* of the glass sheet 104 is first shaped by the coarse grit belt 308*a* and then the medium grit belt 308*b* and finally by the fine grit belt 308*c*. The spaces between the belts 308*a*, 308*b* and 308*c* improve the surface contact between the abrasive belts 308*a*, 308*b* and 308*c* and the edge 102*a* of the glass sheet 104. In addition, the multiple belts 308*a*, 308*b* and 308*c* has advantages for belt usage, surface roughness and edge quality. Plus, the multiple belts 308*a*, 308*b* and 308*c* can minimize edge deflection due to the normal force exerted on the glass sheet 104 by the formed backer 318. This can be important since the thin glass sheet 104 often has a low stiffness. If desired, the belt assembly 108 can have any number of belts 308 with different grit sizes to enable the stepped removal approach to shape the glass sheet 104.

Figure 4:
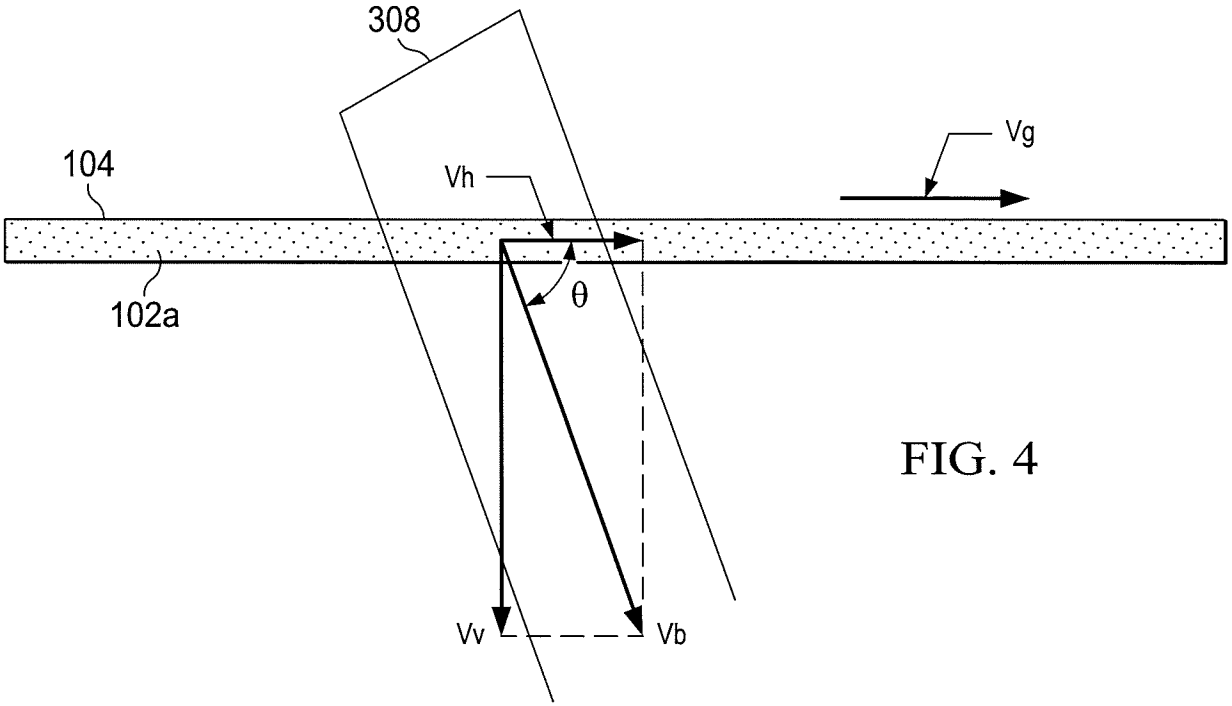
FIG. 4 is a diagram illustrating how a belt (or belts) of the exemplary belt assembly shown in FIGS. 3A-3D can be tilted with respect to the glass sheet while finishing an edge of the glass sheet in accordance with an embodiment of the present invention.

Referring to FIG. 4, there is a diagram illustrating how the belt 308 (or composite belt 308', multiple belts 308*a*, 308*b*, and 308*c*) of belt assembly 108 shown in FIGS. 3A-3D can be tilted with respect to the glass sheet 104 while finishing an edge 102*a* of the glass sheet 104. If desired, the belt assembly 108 may be tilted such that the tilted belt 308 (for example) has a belt surface component $V_h$ which matches the traveling speed $V_g$ of the glass sheet 104. This tilting would be done to achieve a perpendicular grinding of the edge 102*a* of the glass sheet 104. To achieve the condition where the horizontal component of the belt velocity $V_h$ is equal to the glass velocity $V_g$, the belt assembly 108 can be tilted by tilt angle θ. The vertical component of the belt velocity ($V_b$) $V_b$ is represented as $V_v$. The range of the tilt angle θ (e.g., +/−5 degrees) with respect to the horizontal is determined by the speed of the belt 308 and the speed of glass sheet 104 to achieve optimum edge quality and strength. In particular, the tilt angle θ can be changed to achieve a certain orientation of the dominant grind pattern (flaw pattern) on the edge 102*a* of the glass sheet 104 and also to accommodate a change in the speed of the glass sheet 104. Alternatively, one could also change the tilt angle θ based on different glass travelling or belt speeds to maintain a certain ratio to minimize the impact of changes in the belt speed or glass speed on the quality of the grinding of the edge 102*a* of the glass sheet 104. In yet another alternative, one could also change the tilt angle θ to create a cut pattern which is not perpendicular to the edge 102*a* of the glass sheet 104.

From the foregoing, one skilled in the art should appreciate that the present invention not only includes the glass edge finishing system 100, the belt assembly 108 but also a method for finishing one or more edges 102*a* and 102*b* of the glass sheet 104. For instance, the method for finishing an edge 102*a* of the glass sheet 104 can comprise the steps of: (a) moving the glass sheet 104 past one or more belt assemblies 108, where each belt assembly 108 includes: (i) a support frame 302; (ii) a motor 304; (iii) a pair of pulleys 306*a* and 306*b* rotatably mounted on the support frame 302 and driven by the motor 304; (iv) a belt 308 engaged to and driven by the pair of pulleys 306*a* and 306*b*; (v) a belt cleaning device 310; and (vi) a cleaning containment enclosure 312 within which there is located the belt cleaning device 310; and (b) operating the one or more belt assemblies 108, wherein each belt assembly 108 rotates the belt 308 such that the belt 308 contacts and finishes the edge 102*a* of the glass sheet 104, the belt cleaning device 310 removes glass debris from the belt 308 as the belt 308 rotates past the belt cleaning device 310, and the cleaning containment enclosure 312 contains the glass debris removed from the belt 308 by the belt cleaning device 310.

Figure 5:
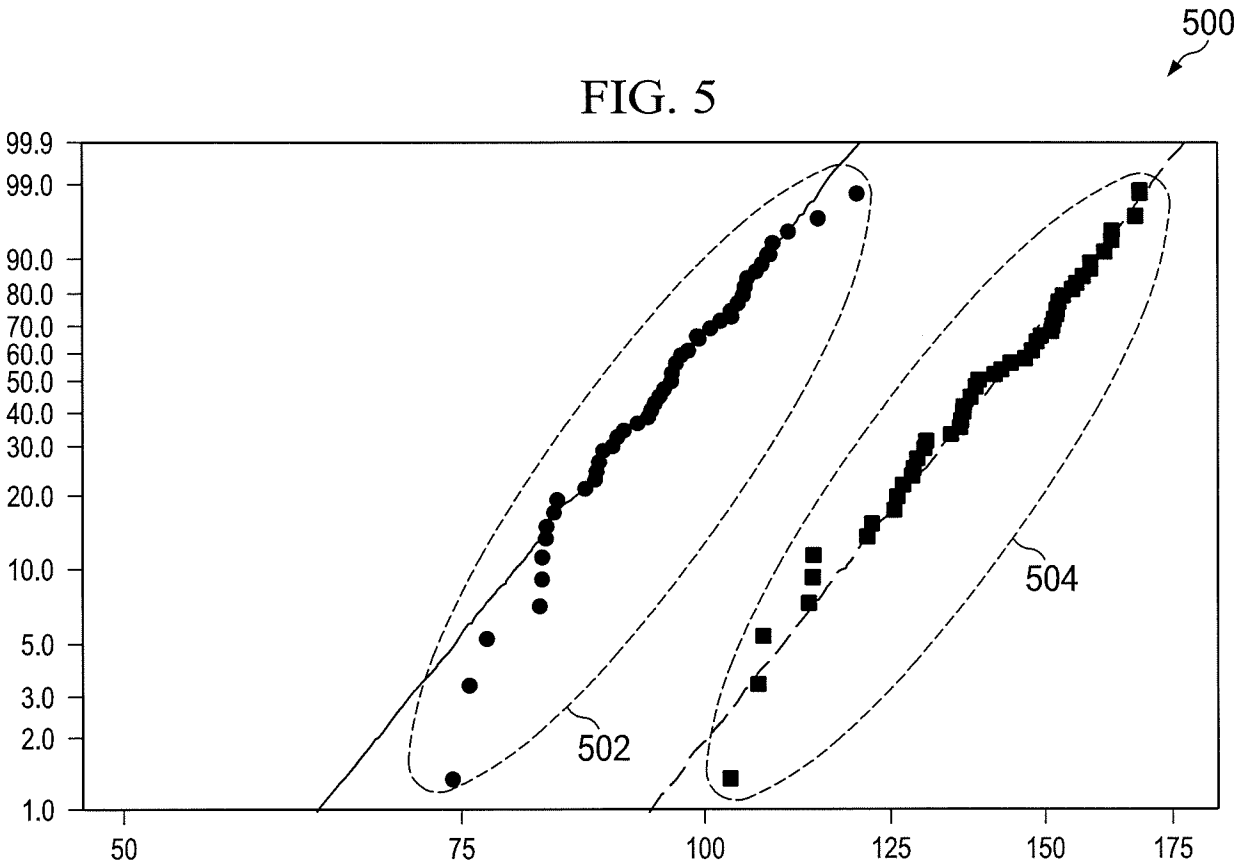
FIG. 5 is a graph illustrating the edge strength requirements that can be meet when using the traditional grinding wheel and the edge strength requirements that can be meet when using the belt assembly shown in FIGS. 3A-3B in accordance with an embodiment of the present invention.

The glass edge finishing system 100, the belt assembly 108 and the method can improve the quality and throughput of the edged glass sheets 104 and particularly the edge shaping of thin glass sheets 104 with a thickness of 3 mm or less. In particular, as stated above the traditional grinding wheel process has several problems, specifically when it comes to edge strength or in another term the durability of the edged glass sheet as it relates to handling. One such handling metric is the bending strength or resistance to breakage during flexure of the edged glass sheet. In this regard, FIG. 5 shows graph 500 which illustrates the edge strength requirements 502 that can be meet when using the traditional grinding wheel and the edge strength requirements 504 that can be meet when using the new belt assembly 108. The graph 500 has an x-axis which represents failure stress (MPa) and the y-axis represents probability of failure (%).

Furthermore, the new glass edge finishing system 100 enables a clean and strong edge finishing process that produces superior surface and edge attributes at a low cost when compared to the traditional grinding wheel process. One way to describe this particular advantage is to explain how glass particles are created when using two different traditional grinding wheel processes and the new glass edge finishing system 100 to edge glass sheets 104. The two different traditional grinding wheel processes and the new glass belt assembly 108 are all discussed in more detail below with respect to FIGS. 6A-6C.

Figure 6A:
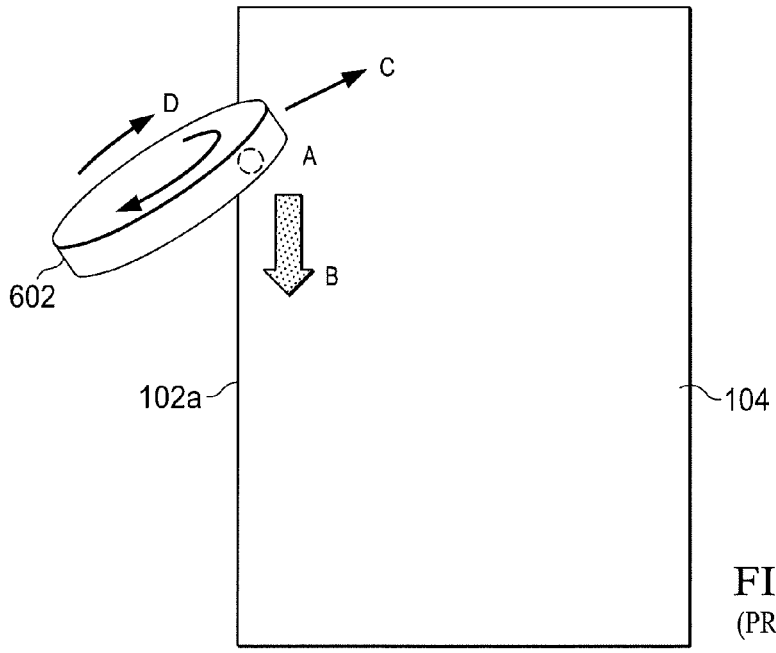
FIG. 6A (PRIOR ART)
FIG. 6A (PRIOR ART) is a diagram illustrating how a traditional cup grinding wheel creates glass particles A, B, C, and D when finishing the edge of the glass sheet.

Referring to FIG. 6A (PRIOR ART), there is a diagram illustrating how the traditional cup grinding wheel 602 creates glass particles A, B, C, and D when finishing the edge 102*a* of the glass sheet 104. The arrows indicate the glass sheet motion, the wheel rotation and the directions of glass particles C and D. The glass particles are as follows: (1) glass particles A which are generated at the grinding zone; (2) glass particles B which are introduced to the surface of the glass sheet 104 through the cooling liquid; (3) glass particles C which are flying particles that land on the glass sheet 104; and (4) glass particles D which are the particles flying off the grinding wheel 602. As can be seen, the glass particles A, B, C and D do not have a distinct direction for easy containment which means the edged glass sheet 104 needs to undergo a costly washing process.

Figure 6B:
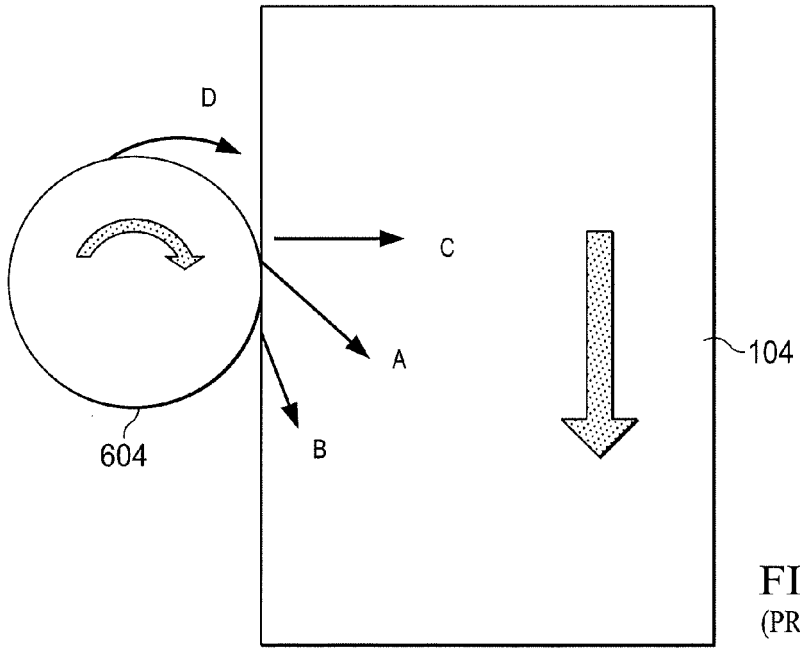
FIG. 6B (PRIOR ART)
FIG. 6B (PRIOR ART) is a diagram illustrating how a traditional formed grinding wheel creates glass particles A, B, C, and D when finishing the edge of the glass sheet.

Referring to FIG. 6B (PRIOR ART), there is a diagram illustrating how the traditional formed grinding wheel 604 creates glass particles A, B, C, and D when finishing the edge 102*a* of the glass sheet 104. The arrows indicate the glass sheet motion, the wheel rotation and the directions of glass particles A, B, C and D. The glass particles are as follows: (1) glass particles A which are generated at the grinding zone; (2) glass particles B which are introduced to the surface of the glass sheet 104 through the cooling liquid; (3) glass particles C which are flying particles that land on the glass sheet 104; and (4) glass particles D which are the particles flying off the grinding wheel 602. As can be seen, the glass particles A, B, C and D do not have a distinct direction for easy containment which means the edged glass sheet 104 needs to undergo a costly washing process.

Figure 6C:
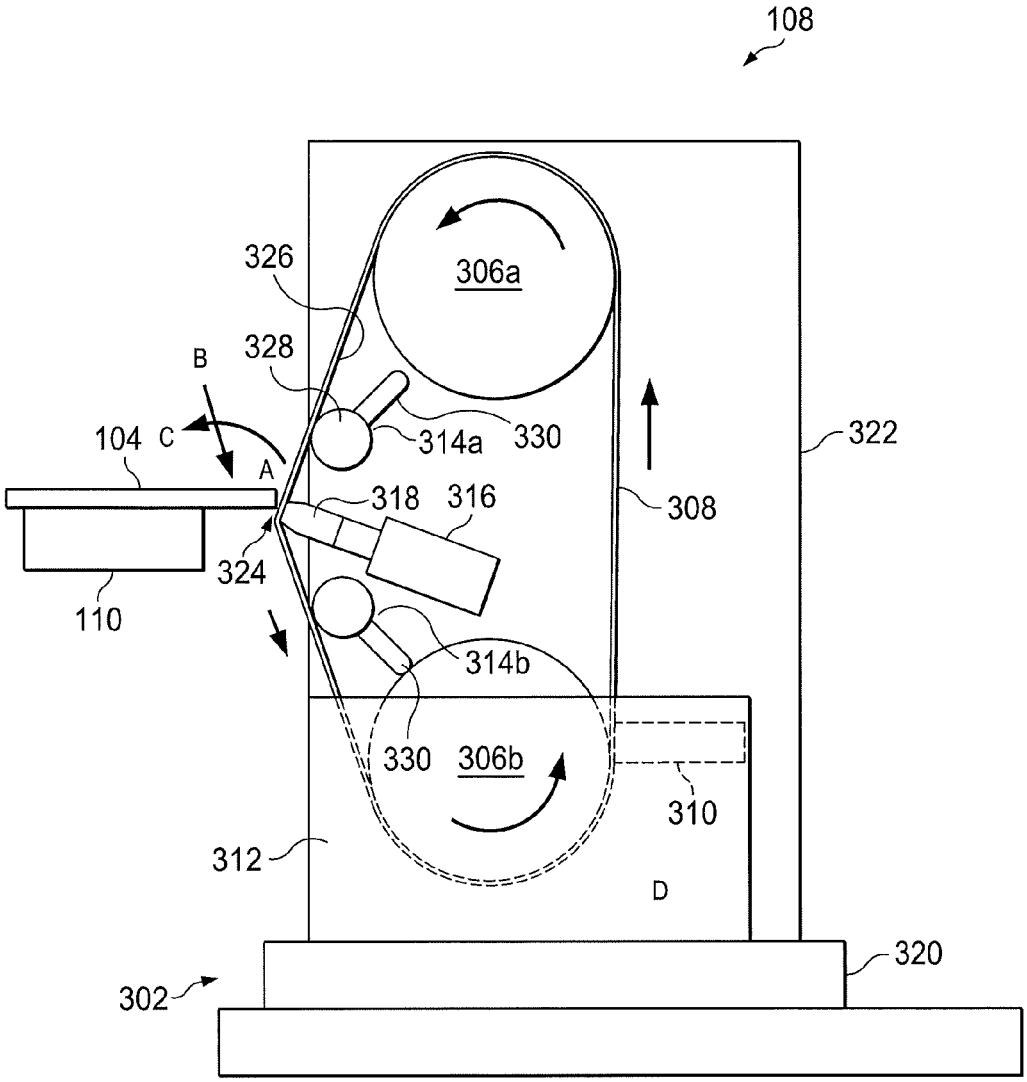
FIG. 6C is a diagram illustrating how the belt assembly shown in FIGS. 3A-3B creates glass particles A, B, C, and D when finishing the edge of the glass sheet in accordance with an embodiment of the present invention.

Referring to FIG. 6C, there is a diagram illustrating how the new belt assembly 108 creates glass particles A, B, C, and D when finishing the edge 102*a* of the glass sheet 104 (note: the detailed description of belt assembly 108 is provided above with respect to FIGS. 3A-3B). The arrows indicate the glass sheet motion, the wheel rotation and the directions of glass particles A, B and C. The glass particles are as follows: (1) glass particles A which are generated at the grinding zone; (2) glass particles B which are introduced to the surface of the glass sheet 104 through the cooling liquid; (3) glass particles C which are flying particles that land on the glass sheet 104; and (4) glass particles D which are the particles removed from the belt 108 by the belt cleaning device 310 and contained within the cleaning containment enclosure 312. As can be seen, the glass particles D are not located on the glass sheet 104 which makes it easier to wash the edged glass sheet 104.

A discussion is provided next to explain in detail how the new glass edge finishing system 100 incorporating the belt assembly 108 addresses each of the ten problems associated with the traditional grinding wheel process discussed above in the "Background" section.

Solution to problem nos. 1 & 2: formed grinding wheels are difficult to make when a small tight radius is required.

Since formed grinding wheels are made using an Electrical Discharge Machining (EDM) process, the tool used to create this form in the grinding wheel can wear quickly and as a result a blunt shape at the bottom of the resultant groove can be formed. This is not desirable for the final shape of the edged glass sheet glass. These problems are resolved by using the belt(s) 308 to create the required form. Plus, the belt(s) 308 can produce the shaped edges 102*a* and 102*b* of the glass sheet 104 for a much longer period of time when compared to using the formed grinding wheel due to the larger surface area of the belt(s) 308 and the fact the formed backer 318 has very little wear as compared to the grinding wheel process.

Solution to problem no. 3: since there is a significant increase in surface area and the ability to use the entire grinding matrix on the abrasive belt(s) 308 it is more cost effective when compared to using the grinding wheel which may use diamonds as the grinding matrix. Thus, the use of belt(s) 308 will not only decrease yearly consumable cost but also production costs since line downtime associated with changing belt(s) 308 is much less when compared changing grinding wheels.

Solution to problem nos. 4, 5, 6 and 7: since the belt(s) 308 are typically flat one side of the glass sheet 104 can be shaped at a time which means the glass particles A and C can be released more freely when compared to the grinding wheel process thus preventing material buildup which can cause undesirable chipping. Since, the belt(s) 308 also have a large surface area that can come into contact with the glass sheet 104 during the grinding process this means that the belts grain size can be reduced which results in a finer, smoother surface on the edged glass sheet 104.

Solution to problem no. 8: since the belt assembly 108 when compared to the grinding wheel process uses a gentler edge grinding process this causes the grinding debris (e.g. glass particles D) to stay in a small area and mainly cling to the abrasive belt(s) 308 so the belt cleaning device 310 can remove the glass particles D which will result in a much cleaner final edged glass sheet 104.

Solution to problem no. 9: since the belt grinding process is gentler than grinding with a grinding wheel this means that the surface finish produced on the glass sheet 104 has less defects within which glass debris can become trapped.

Solution to problem no. 10: since the belt grinding process requires less precision when compared to the grinding wheel process which has problematical precision limitations due to the machine systems used to position the grinding wheel this is desirable when it comes to reducing the amount of stock used.

Although several embodiments of the present invention have been illustrated in the accompanying Drawings and described in the foregoing Detailed Description, it should be understood that the invention is not limited to the disclosed embodiments, but is capable of numerous rearrangements, modifications and substitutions without departing from the invention as set forth and defined by the following claims. It should also be noted that the reference to the "present invention" or "invention" used herein relates to exemplary embodiments and not necessarily to every embodiment that is encompassed by the appended claims.

The invention claimed is:

1. A glass edge finishing system for finishing an edge of a glass sheet, the glass edge finishing system comprising:

a base;

one or more belt assemblies located on the base, where each belt assembly includes:

a support frame;

a motor;

a pair of pulleys rotatably mounted on the support frame and driven by the motor;

a belt engaged to and driven by the pair of pulleys, where the belt contacts and finishes the edge of the glass sheet;

a pair of tension rollers positioned between the pair of pulleys so as to contact and press against an inner side of the belt to apply a predetermined tension to the abrasive belt;

a combined pusher and formed backer located between the pair of tension rollers, wherein the pusher moves the formed backer against the inner side of the belt such that an opposite outer side of the belt is pushed outward so as to contact the edge of the glass sheet;

a belt cleaning device that removes glass debris from the belt as the belt moves past the belt cleaning device; and a cleaning containment enclosure within which there is located the belt cleaning device, where the cleaning containment enclosure contains the glass debris removed from the belt by the belt cleaning device.

2. The glass edge finishing system of claim 1, further comprising:

a vacuum table on which the glass sheet is placed; and a motion system that moves the vacuum table and the glass sheet past the one or more belt assemblies.

3. The glass edge finishing system of claim 1, further comprising a coolant delivery system that delivers a coolant to an edging zone where the belt contacts and finishes the edge of the glass sheet.

4. The glass edge finishing system of claim 2, further comprising a controller that controls at least the one or more belt assemblies.

5. The glass edge finishing system of claim 1, wherein the formed backer has a flat end, a round end, or a shaped end.

6. The glass edge finishing system of claim 1, wherein the belt cleaning device is a brush or a spray nozzle.

7. The glass edge finishing system of claim 1, wherein the belt is a composite belt which includes multiple meshes.

8. The glass edge finishing system of claim 1, wherein each belt assembly includes multiple belts that are engaged to and driven by the pair of pulleys.

9. The glass edge finishing system of claim 1, wherein the belt is tilted at an angle with respect to the edge of the glass sheet to achieve a condition where a horizontal component (Vh) of a velocity of the rotating belt is equal to a velocity (Vg) of the glass sheet to create a grinding pattern that is substantially perpendicular to the edge of the glass sheet.

10. The glass edge finishing system of claim 1, wherein the belt is tilted at an angle with respect to the edge of the glass sheet to create a grinding pattern that is not substantially perpendicular to the edge of the glass sheet.

11. The glass edge finishing system of claim 1, wherein the one or more belt assemblies comprise:

a first belt assembly positioned to shape one side of the edge of the glass sheet; and a second belt assembly positioned to shape another side of the edge of the glass sheet.

12. A belt assembly for finishing an edge of a glass sheet, the belt assembly comprising:

a support frame;

a motor;

a pair of pulleys rotatably mounted on the support frame and driven by the motor;

a belt engaged to and driven by the pair of pulleys, where the belt contacts and finishes the edge of the glass sheet;

a pair of tension rollers positioned between the pair of pulleys so as to contact and press against an inner side of the belt to apply a predetermined tension to the abrasive belt;

a combined pusher and formed backer located between the pair of tension rollers, wherein the pusher moves the formed backer against the inner side of the belt such that an opposite outer side of the belt is pushed outward so as to contact the edge of the glass sheet;

a belt cleaning device that removes glass debris from the belt as the belt moves past the belt cleaning device; and a cleaning containment enclosure within which there is located the belt cleaning device, where the cleaning containment enclosure contains the glass debris removed from the belt by the belt cleaning device.

13. The belt assembly of claim 12, further comprising a controller that controls at least the motor.

14. The belt assembly of claim 12, wherein the formed backer has a flat end, a round end, or a shaped end.

15. The belt assembly of claim 12, wherein the belt cleaning device is a brush or a spray nozzle.

16. The belt assembly of claim 12, wherein the belt is a composite belt which includes multiple meshes.

17. The belt assembly of claim 12, further comprising multiple belts that are engaged to and driven by the pair of pulleys.

18. The belt assembly of claim 12, wherein the belt is tilted at an angle with respect to the edge of the glass sheet to achieve a condition where a horizontal component (Vh) of a velocity of the rotating belt is equal to a velocity (Vg) of the glass sheet to create a grinding pattern that is substantially perpendicular to the edge of the glass sheet.

19. The belt assembly of claim 12, wherein the belt is tilted at an angle with respect to the edge of the glass sheet to create a grinding pattern that is not substantially perpendicular to the edge of the glass sheet.

20. A method for finishing an edge of a glass sheet, the method comprising the steps of:

moving the glass sheet past one or more belt assemblies, where each belt assembly includes:

a support frame;

a motor;

a pair of pulleys rotatably mounted on the support frame and driven by the motor;

a belt engaged to and driven by the pair of pulleys;

a pair of tension rollers positioned between the pair of pulleys so as to contact and press against an inner side of the belt to apply a predetermined tension to the abrasive belt;

a combined pusher and formed backer located between the pair of tension rollers, wherein the pusher moves the formed backer against the inner side of the belt such that an opposite outer side of the belt is pushed outward so as to contact the edge of the glass sheet;

a belt cleaning device; and a cleaning containment enclosure within which there is located the belt cleaning device; and operating the one or more belt assemblies, wherein each belt assembly rotates the belt such that the belt contacts and finishes the edge of the glass sheet, the belt cleaning device removes glass debris from the belt as the belt moves past the belt cleaning device, and the cleaning containment enclosure contains the glass debris removed from the belt by the belt cleaning device.

21. The method of claim 20, further comprising step of tilting the belt of each belt assembly at an angle with respect to the edge of the glass sheet to achieve a condition where a horizontal component (Vh) of a velocity of the rotating belt is equal to a velocity (Vg) of the glass sheet to create a grinding pattern that is substantially perpendicular to the edge of the glass sheet.

22. A belt assembly for finishing an edge of a glass sheet, the belt assembly comprising:

a support frame;

a motor;

a pair of pulleys rotatably mounted on the support frame and driven by the motor;

a belt engaged to and driven by the pair of pulleys, where the belt contacts and finishes the edge of the glass sheet;

a pair of tension rollers positioned between the pair of pulleys so as to contact and press against an inner side of the belt to apply a predetermined tension to the abrasive belt;

a combined pusher and back-up roller located between the pair of tension rollers, wherein the pusher moves the back-up roller against the inner side of the belt such that an opposite outer side of the belt is pushed outward so as to contact the edge of the glass sheet;

a belt cleaning device that removes glass debris from the belt as the belt moves past the belt cleaning device; and a cleaning containment enclosure within which there is located the belt cleaning device, where the cleaning containment enclosure contains the glass debris removed from the belt by the belt cleaning device.

* * * * *